United States Patent [19]

Seko et al.

[11] 4,111,779

[45] Sep. 5, 1978

[54] BIPOLAR SYSTEM ELECTROLYTIC CELL

[75] Inventors: Maomi Seko, Tokyo; Shinsaku Ogawa, Nobeoka; Nobuo Ajiki, Nobeoka; Muneo Yoshida, Nobeoka, all of Japan

[73] Assignee: Asahi Kasei Kogyo Kabushiki Kaisha, Osaka, Japan

[21] Appl. No.: 790,924

[22] Filed: Apr. 26, 1977

Related U.S. Application Data

[63] Continuation of Ser. No. 619,505, Oct. 3, 1975, abandoned.

[30] Foreign Application Priority Data

Oct. 9, 1974 [JP] Japan ..... 49-116695

[51] Int. Cl.[2] ..... C25B 9/00

[52] U.S. Cl. ..... 204/255; 204/268

[58] Field of Search ..... 204/254–256, 204/268

[56] References Cited

U.S. PATENT DOCUMENTS

| | | | |
|---|---|---|---|
| 3,849,280 | 11/1974 | Raetzsch et al. | 204/254 X |
| 3,856,651 | 12/1974 | Raetzsch et al. | 204/255 |
| 3,859,197 | 1/1975 | Bouy et al. | 204/254 X |
| 3,876,517 | 4/1975 | Raetzsch et al. | 204/256 X |
| 3,910,827 | 10/1975 | Raetzsch et al. | 204/254 X |
| 4,017,375 | 4/1977 | Pohto | 204/255 |

*Primary Examiner*—Charles F. LeFevour

*Attorney, Agent, or Firm*—Cooper, Dunham, Clark, Griffin & Moran

[57] ABSTRACT

A bipolar system electrolytic cell having a partition wall made of explosion-bonded titanium plate and iron plate which is electrically connected to anode of titanium substrate at its titanium side and to cathode of iron at its iron side, space is preferably given between anode and the partition wall and also between cathode and the partition wall. An assembly having a number of such unit cells arranged in series is useful for electrolysis of sodium chloride which can be performed under a low voltage per unit cell.

8 Claims, 3 Drawing Figures

BIPOLAR SYSTEM ELECTROLYTIC CELL

This is a continuation of application Ser. No. 619,505 filed Oct. 3, 1975, now abandoned.

This invention relates to a novel electrolytic cell.

There have been known various bipolar system electrolytic cells wherein partition walls between anode chamber and cathode chamber are made of plastics excellent in corrosion resistance and electric insulation such as polyvinyl chloride, heat-resistant polyvinyl chloride, polyethylene, polypropylene, polyester, epoxy resin, rubber and/or iron plates lined with these plastics, concrete, etc. However, when partition walls are made of plastics or concrete only, they are necessarily required to be thick from the standpoint of strength. Accordingly, no small electrolytic cell narrow in thickness can be produced. On the other hand, while partition walls made of iron plates lined with plastics, etc. are less expensive, plastics linings are generally easily peeled off. When anode and cathode are intended to be electrically connected through partition wall in construction of bipolar system electrolytic cell, plastics lining is especially liable to be peeled off at the surface through which such a connection is passed, whereby electrolytic cell is required to have a complicated structure. Furthermore, generally speaking, the temperature of electrolyte is preferably as high as possible, for example, higher than 80° C in order to increase the electric conductivity thereof. Therefore, plastics in general except for special ones cannot stand such a high temperature. In addition, anode chambers are generally subjected to severe oxidizing atmosphere. Conventional plastics cannot stand such a severe oxidizing atmosphere.

Metallic titanium, which is known to be resistant to severe oxidizing atmosphere at high temperature, cannot directly be welded with iron. Metallic titanium is readily oxidized in oxidizing atmosphere to form strong oxide coating which has excellent electrically insulating property. Accordingly, when metallic titanium is connected with iron by, for example, mechanical connection such as setsscrew, electrically insulating coating is formed at the connected surface to render the connection electrically insulated. Thus, no bipolar system electrolytic cell, which can stably be operated for a long term, can be produced by use of such a combination. Furthermore, metallic titanium is not corrosion-resistant in reducing atmosphere, while it is corrosion-resistant in oxidizing atmosphere. Therefore, metallic titanium cannot be exposed in cathode chamber. Due to the reasons as set forth above, it has been difficult to employ titanium as partition wall of bipolar system electrolytic cell.

The present invention provides a novel bipolar system electrolytic cell, comprising a partition wall made of explosion-bonded titanium plate and iron plate which partitions said cell into anode chamber and cathode chamber, an anode of titanium substrate having platinum group metal oxides coated thereon which is connected electrically to titanium of said partition wall and a cathode of iron which is connected electrically to iron of said partition wall.

According to one preferred embodiment of the present invention, the bipolar system electrolytic cell comprises a partition wall made of explosion-bonded titanium plate and iron plate which partitions said cell into anode chamber and cathode chamber, an anode of titanium substrate having platinum group metal oxides coated thereon which is connected electrically to titanium of said partition wall in a manner such that space is provided between said anode and titanium of said partition wall and a cathode of iron which is connected electrically to iron of said partition wall in a manner such that space is provided between said cathode and iron of said partition wall.

According to another preferred embodiment of the present invention, there is provided an electrolytic cell having a number of bipolar system electrolytic unit cells arranged in series and having cation exchange membranes interposed between cathode chamber and anode chamber of neighboring unit cells, respectively, each unit cell comprising a partition wall made of explosion-bonded titanium plate and iron plate which partitions each unit cell into said cathode and anode chambers, an anode of titanium plate having platinum group metal oxides coated thereon which is connected electrically to titanium plate of said partition wall and a cathode of iron plate which is connected electrically to iron plate of said partition wall.

One of the most important features of the present invention resides in use of explosion-bonded titanium plate and iron plate as partition plate. The "explosion-bonded titanium plate and iron plate" herein used refers to titanium plate and iron plate which are pressure bonded to each other by utilizing explosive force of explosive powder. The bonded plate may also be subjected to hot or cold rolling before use. In general, a bonded plate subjected to hot rolling is preferred, since a thin titanium plate can be welded therewith and it is excellent in flatness and low in cost. The titanium plate and the iron plate in the aforesaid explosion-bonded plate are completely attached to each other and there is substantially no oxide coating. Hence, titanium and iron are excellent in electric contact without change in electric conductivity with passage of time. Furthermore, there is little voltage drop at the contacted portion between iron and titanium and electrolysis can be performed at a high temperature. Since the anode chamber side of the partition wall of the present invention is made of titanium, it can directly or indirectly through titanium plate or rod be welded with anode. Likewise, cathode can be welded with the partition wall at the cathode chamber side thereof. Thus, there is no fear of formation of electric insulating coating film.

The "titanium plate" herein used for the partition wall as well as for the substrate of anode includes not only those made of metallic titanium but also those made of titanium alloys.

The "iron plate" herein used for the partition wall as well as for the substrate of cathode includes not only those made of iron only but also those made of iron alloys containing nickel, chromium, molybdenum, carbon, etc. In addition, modified cathode improved in corrosion resistance or lowered in hydrogen overvoltage such as those made by plating with nickel or nickel rhodanide are also included in the present invention.

The anode to be employed in the electrolytic cell of the present invention consists of titanium substrate and platinum metal group oxides coated thereon. Said platinum metal oxide includes oxides of platinum metal group such as ruthenium, rhodium, palladium, osmium, iridium, platinum, etc. In addition to those coated with platinum metal group oxides only, the anode may be coated with a mixture or an eutectic mixture of platinum group metal oxides with other metal oxides such as titanium oxide, zirconium oxide, silicon oxide, aluminum oxide, boron oxide, etc. Furthermore, metallic platinum group metal may also be contained in said coating. Alternatively, an anode of titanium plated with a platinum group metal may also be used.

The structure of anode is preferably such that it has a gas-permeable structure including large proportion of interstices or openings, e.g. in shapes such as a porous plate, parallel rods, nets, etc. This is because titanium substrate is very expensive, on one hand, and also because gas discharge is alleviated by such a structure, on the other. By the presence of openings, back surface as well as the side surface of anode can function as effective electrode area. Furthermore, since anode is generally accompanied by generation of gases such as chlorine gas or oxygen gas, the anode having much openings such as porous plate, parallel rods, nets, etc. can permit the gases to be discharged backside of the anode, whereby electrolysis current is prevented from shielding by gas to lower the electrolysis voltage. The "porous plate" includes not only a perforated flat plate but also such a product as expanded metal. In view of easy fabrication as well as low cost, expanded metal is preferably used.

As mentioned above, it is preferred to provide space between the partition wall and the anode in the electrolytic cell of the present invention. Such a space is preferably as large as possible, since the gas is discharged backside of the anode, whereby separation of gas is alleviated to lower the electrolysis voltage. In order to electrically connect the patition wall with the anode, while providing a space therebetween, the titanium surface of the partition wall may directly be connected with the titanium substrate of the anode. Alternatively, it may indirectly be connected with the titanium substrate of the anode through a support such as titanium plate, or titanium rod, etc. In particular, when titanium plate support is arranged vertically, the partition wall can be reinforced thereby and the aforesaid effect of gas phase is not disturbed at all.

The cathode to be employed in the present invention, which is made of iron material as mentioned above, has preferably such a structure as porous plates, parallel rods, nets, etc. by the same reasons as described with reference to the anode, especially when gas such as hydrogen gas is generated from the cathode, e.g. in case of production of caustic soda. Furthermore, the cathode and the partition wall are electrically connected and it is also preferred to provide a space with an interval of 10 mm or more between the cathode and the partition wall, since titanium plate is prevented from degradation or peel-off caused by the atomic hydrogen generated at the cathode which penetrates through the iron surface of the partition wall. Thus, the electrolytic cell is prevented from increase in electrolysis voltage caused by shielding of electrolysis current by the generated gas.

A number of unit cells as described above are arranged in series like an assembly of a filter-press and cation exchange membranes are interposed between unit cells, respectively, to separate anode chambers from cathode chambers, thus providing an assembly of a bipolar system electrolytic cell which is provided for use. The number of unit cells is two or more, preferably 20 or more. In construction of said assembly, care is taken so that there may be no leak. Each anode chamber has parallel inlet and outlet for supply and discharge, respectively, of anolyte; each cathode chamber has also a smilar structure for supply and discharge of catholyte. When a direct current is charged between both terminals of such an electrolytic cell, current flows in series.

The cation exchange membranes to be used in the present invention include fluorine-containing resins having cation exchange groups such as sulfonic acid type, carboxylic acid type, phosphoric acid type, etc. and cation exchange membranes of which substrate polymers are cross-linked hydrocarbon resins such as styrene-divinyl benzene.

In order that the invention may be clearly understood and readily carried into effect, embodiments thereof will now be described by way of example with reference to the accompanying drawings, in which.

Figure 1:
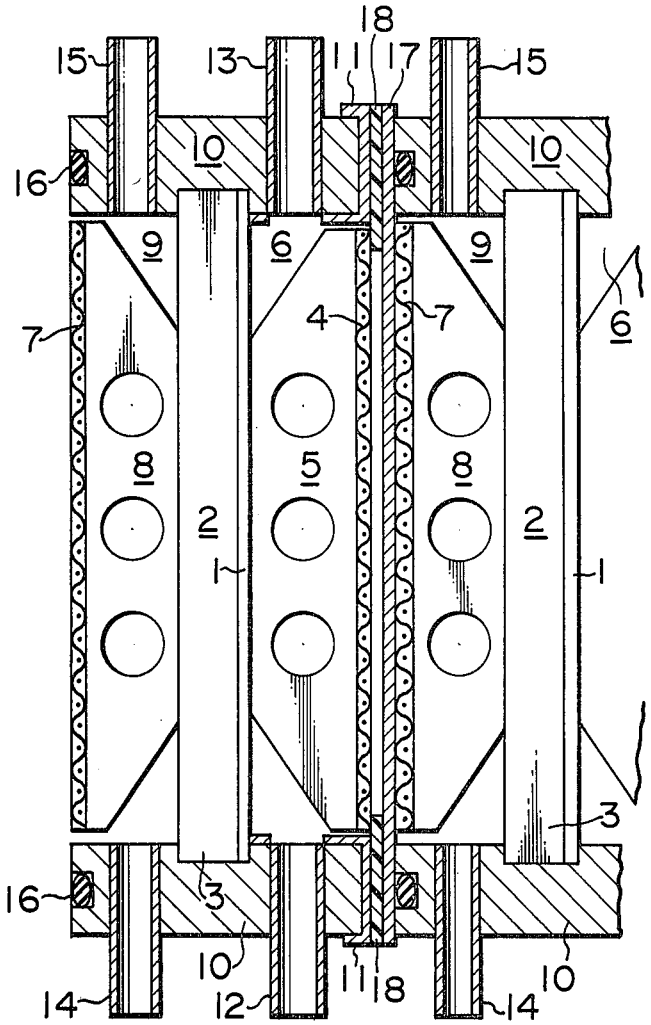
FIG. 1 is a cross-sectional view of one embodiment of the electrolytic cell of the invention.
Figure 2:
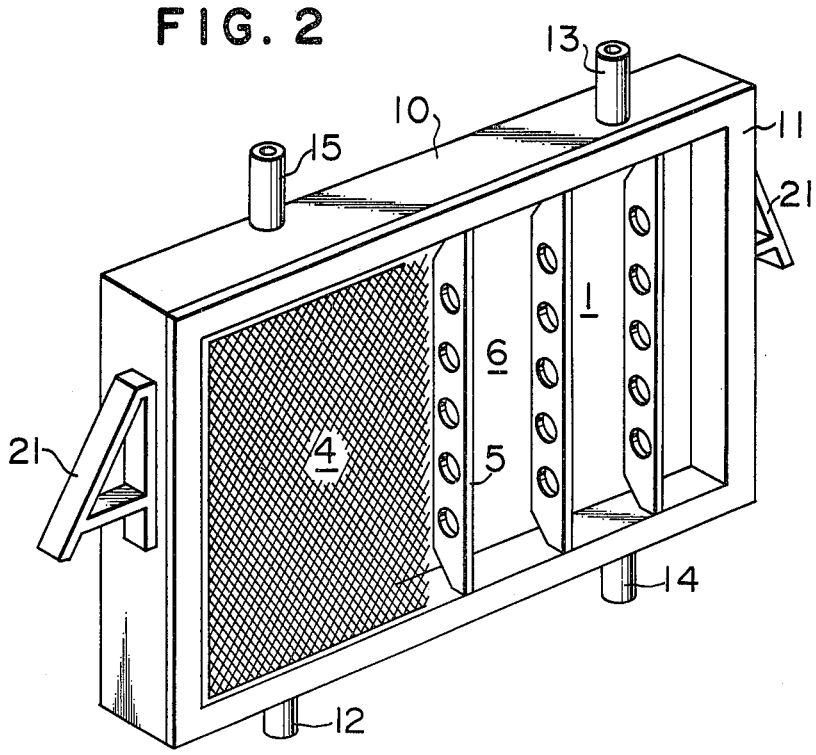
FIG. 2 is a slant view, viewd from the anode side.
Figure 3:
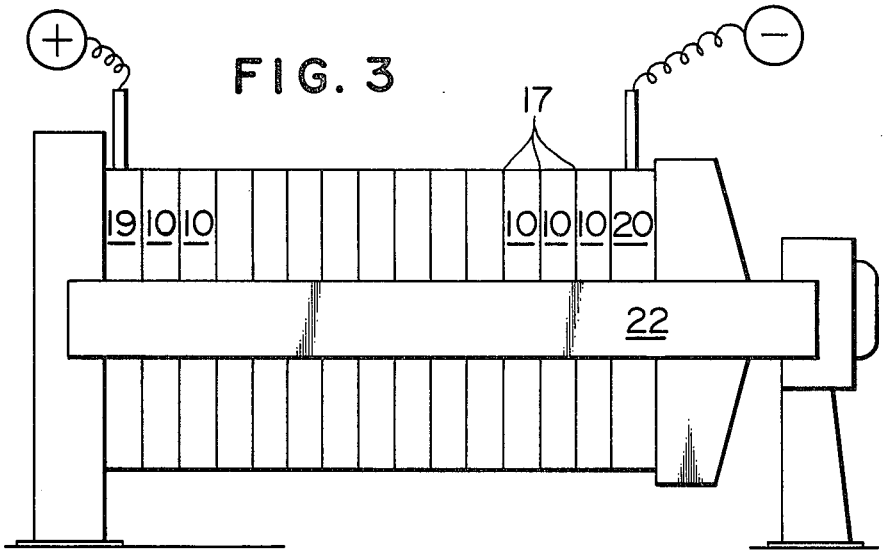
FIG. 3 is an assembly of bipolar system electrolytic cell of the invention.

The partition wall 3, having the titanium plate 1 and the iron plate 2 explosion-bonded at the titanium surface thereof, is welded through the titanium plate 5 which is arranged vertically with the anode 4 wherein expanded titanium plate is coated with a platinum group metal oxide. There is also formed a space which provides the anode chamber 6. The cathode 7 which is made of expanded iron plate is welded with the partition wall at the iron plate 2 through iron plate 8 vertically arranged, and a space is formed for the cathode chamber 9. There is the iron frame 10 in the circumference of the anode chamber 6 and the cathode chamber 9. Said iron frame is lined with titanium at the surface which can be contacted with the anolyte. The iron frame 10 is welded with the iron side of the partition wall at the circumference thereof. The titanium lining 11 is also welded with the titanium side 1 of the partition wall at the circumference thereof. Thus, the anode chamber is completely separated from the cathode chamber. The anode chamber is provided with the supply nozzle 12 and the discharge nozzle 13 for anolyte, which are made of titanium. The cathode chamber is provided with the supply nozzle 14 and the discharge nozzle 15 for catholyte, which are made of iron. The frame 10 may either be provided or not provided with o-ring channel 16 for liquid seal. The cation exchange membrane 17 is interposed as diaphragm between the cathode 7 and the anode 4. The packing 18 may be provided between the iron frame 10 and the cation exchange membrane 17 for the purpose of adjustment of inter-electrode distance and/or electric insulation. Controlling plates (not shown) may also be provided in the cathode chamber and the anode chamber in order to improve stirring effect of electrolyte by gas. Headers (not shown) may also be provided at the top of the cathode chamber and the anode chamber for separation of gas from liquid.

A number of unit cells as described above are arranged in series and the cation exchange membranes are interposed between unit cells, respectively. At the both ends, there are arranged the electrolytic cell 19 having anode chamber only and a terminal for passage of current and the electrolytic cell 20 having cathode chamber only and a terminal for passage of current. Thus, the unit cells are assembled together to be liquid tight without leak to form bipolar system electrolytic cell. For convenience of assembly, the arms 21 are provided at both sides of the iron frame 10 of the unit electrolytic cell. Said arms are mounted on the press stand 22 having side bar.

The bipolar system electrolytic cell of the present invention can be used for various uses. For example, it is particularly suitable for production of chlorine gas, hydrogen gas and caustic soda by supplying aqueous sodium chloride solution as anolyte and aqueous caustic soda solution as catholyte.

The present invention is illustrated in further detail by referring to the following Examples, which are shown for the purpose of illustration only.

EXAMPLE 1

In the electrolytic cell as shown in the accompanying drawings, the partition wall 3 which is 1.2 m long and 2.4 m wide is prepared by explosion-bonding iron plates with titanium plate, followed by hot rolling. The titanium plate 1 is 1 mm and the iron plate 9 mm in thickness. A porous titanium plate which is prepared by expanding titanium plate with thickness of 1.5 mm, having opening ratio of 60%, is coated, 5μ thick, with an eutectic mixture comprising 60 mol % ruthenium oxide, 30 mol % titanium oxide and 10 mol % zirconium oxide to provide the anode 4. In order to provide 25 mm of the space 6 for the anode chamber between the anode 4 and the titanium of the partition wall, the titanium plate 5 which is 4 mm thick, 25 mm wide and 1.2 m long is arranged at the interval of 10 cm. Said titanium plate is arranged vertically so as not to disturb the stirring effect by gas and provided with 10 holes of about 10 mm in diameter so as to permit horizontal mixing of the liquid. The titanium plate 5, the titanium 1 of the partition wall and the anode 4 are connected to one another by means of welding so as to reduce the electric resistance as much as possible. As the cathode 7, an expanded porous plate with opening ratio of 60% which is prepared from 1.6 mm iron plate is used. In order to provide 45 mm of the space 9 for the cathode chamber between the cathode 7 and the partition wall, there is vertically arranged the iron plate 8 which is 6 mm thick, 45 mm wide and about 1.2 m long and provided with 10 holes of about 10 mm in diameter. The cathode 7, the iron plate 8 and the iron 2 of the partition wall are connected to one another by means of welding so as to reduce the electric resistance as much as possible. There is the iron frame with thickness of 16 mm around the partition wall 3 and it is lined with titanium plate 11 with thickness of 2 mm at the surface in contact with the anolyte. The interval between the cathode 7 and the anode 4 are maintained at about 2 mm by the packing of ethylene-propylene rubber with thickness of 2 mm. As the cation exchange resin 17, a sulfonic acid type resin made from fluoro-resin substrate reinforced with fluoro-fiber cloth is used.

A bipolar system electrolytic cell assembly is made by arrangement of 80 unit electrolytic cells as described above, and at both ends thereof the electrolytic cell 20 having only cathode chamber and the electrolytic cell 19 having only anode chamber, followed by pressing on the press stand 22 having side bar.

To the liquid supply nozzle 12 of each anode chamber is supplied an aqueous sodium chloride solution through the pipes arranged parallel to each other from the anolyte tank. From the liquid discharge nozzle 13 is discharged the anolyte comprising sodium chloride solution and chlorine gas through the pipes arranged similarly parallel to each other, which is then returned to the anolyte tank.

To the liquid supply nozzle 14 of each cathode chamber is supplied an aqueous caustic soda solution through the pipes arranged parallel to each other from the catholyte tank and from the liquid discharge nozzle 15 is discharged 20 wt. % aqueous caustic soda solution and hydrogen gas, which is then returned to the catholyte tank.

When direct current of 14,000 ampere is passed through the bipolar system electrolytic cell as described above at an electrolysis temperature of 92° C, the voltage per unit cell is only 3.6 volt. The voltage drop between the cathode 7 and the anode 4 through the partition wall 3 is merely several millivolt, which clearly shows the advantage of the structure having explosion-bonded partition wall.

REFERENCE EXAMPLE 1

In this reference example, heat-resistant polyvinyl chloride resin plate is used as the partition wall.

The same anode and cathode as in Example 1 are used. The corresponding titanium plates 5 are arranged at the intervals of 10 cm and titanium plates with thickness of 10 mm and width of 15 cm are arranged for distribution of current between said titanium plates rod of 10 cm in diameter which is welded with the aforesaid titanium plate is penetrated through the partition wall of heat-resistant polyvinyl chloride. The cathode side is also provided with the same structure as the anode side and both sides are connected by setsscrew on the penetrated portion of the heat-resistant polyvinyl chloride.

Although the size of the cathode chamber, the size of the anode chamber, the cation exchange membrane, the anolyte concentration and the catholyte concentration are the same as in Example 1, the voltage drop between the cathode and the anode through the partition wall is as much as about 200 millivolt when direct current of 14,000 ampere is passed. The heat-resistant polyvinyl chloride is observed to be molten at the penetrated portion by the heat evolved at an electrolysis temperature of 70° C. Therefore, electrolysis can no longer be continued. Furthermore, the electrolysis voltage is as high as 4.7 volt per unit cell, since the electrolysis temperature cannot be elevated to a high temperature. Thus, no large scale electrolytic cell can be produced by using heat-resistant polyvinyl chloride as the partition wall, because no great current can be passed and the electrolysis voltage cannot sufficiently be elevated.

EXAMPLE 2

In this Example, explosion-bonded titanium plate and iron plate is used as the partition wall, but plate electrodes having no space therebehind are used in the bipolar system electrolytic cell.

The same partition wall as in Example 1 is used. A flat plate anode, wherein the surface of titanium 1 of the partition wall is coated directly, 5μ thick, with the same eutectic mixture as in Example 1 comprising 60 mol % ruthenium oxide, 30 mol % titanium oxide and 10 mol % zirconium oxide, is used. As for cathode, the iron of the partition wall is shaped in flat plate to be provided for use as cathode. The same cation exchange membrane as in Example 1 is used.

The distance between the cathode and the cation exchange membrane and that between the anode and the cation exchange membrane are 3.5 mm, respectively. This is because there must be provided slits for supply and discharge of liquids to and from the anode and the cathode chambers, respectively, and packings for prevention of leak, etc.

Using this electrolytic cell, electrolysis is performed under the same conditions with respect to the anolyte concentration, the catholyte concentration, the amount of the anolyte, the amount of the catholyte and the electrolysis temperature. When a current of only 2500 ampere is passed, the electrolysis voltage becomes as much as 3.6 volt per unit cell, because the current is shielded by chlorine gas and hydrogen gas generated. This result clearly shows the advantageous effect of an electrolytic cell having a porous plate electrode structure and having space between the partition wall and electrode.

EXAMPLE 3

The same electrolytic cell as in Example 1 is used, except that the cathode surface is subjected to nickel plating in a bath containing 250g/l $NiSO_4 \cdot 7H_2O$, 50 g/l $NiCl_2.6H_2O$ and 45 g/l boric acid at 2 $A/dm^2$ to thickness of 10 microns and further to plating in a bath containing 200 g/l $NiSO_4.7H_2O$, 30 g/l $NiCl_2.6H_2O$, 20 g/l of boric acid and 16 g/l ammonium rhodanide at 1 $A/dm^2$ to thickness of about 15 microns.

The cathode is low in hydrogen overvoltage and the voltage per unit cell is only 3.5 volt when electrolysis is performed under the same conditions as in Example 1.

What we claim is:

1. An electrolyzer comprising a plurality of bipolar system unit cells disposed alternately with cation exchange membranes therebetween, each unit cell comprising a partition wall consisting of an explosion-bonded titanium plate and iron plate which partitions said cell into an anode chamber and a cathode chamber, an anode which is a titanium substrate coated with platinum group metal oxides, the said anode being electrically connected to the titanium of said partition wall and an iron cathode electrically connected to the iron of said partition wall; there being an interval of at least 10 mm between the cathode and the partition wall.

2. An electrolytic cell as claimed in claim 1, wherein the partition wall is made by explosion-bonding titanium plate and iron plate, followed by hot rolling.

3. An electrolytic cell as claimed in claim 1 wherein the anode has a gas-permeable structure.

4. An electrolytic cell as claimed in claim 1 wherein the cathode has a gas-permeable structure.

5. An electrolytic cell as claimed in claim 3, wherein the anode is an expanded metal.

6. An electrolytic cell as claimed in claim 4, wherein the cathode is an expanded metal.

7. An electroytic cell as claimed in claim 1, wherein space is provided between the anode and the partition wall.

8. An electrolytic cell as claimed in claim 7, wherein space is provided by connecting titanium substrate of the anode with titanium of the partition wall indirectly through a titanium support which is vertically arranged.

* * * * *